US006257854B1

(12) United States Patent
Fang et al.

(10) Patent No.: US 6,257,854 B1
(45) Date of Patent: Jul. 10, 2001

(54) DOUBLE SCREW ROTOR ASSEMBLY HAVING MEANS TO AUTOMATICALLY ADJUST THE CLEARANCE BY PRESSURE DIFFERENCE

(75) Inventors: Hong-Sheng Fang; Ming-Hsin Liu; Cheng-Chan Tsai, all of Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/589,126

(22) Filed: Jun. 8, 2000

(30) Foreign Application Priority Data

Feb. 2, 2000 (TW) ..... 89201922

(51) Int. Cl.[7] ..... F03C 2/00
(52) U.S. Cl. ..... 418/194; 418/149; 418/107
(58) Field of Search ..... 418/194, 149, 418/107

(56) References Cited

U.S. PATENT DOCUMENTS

| | | | | |
|---|---|---|---|---|
| 2,707,441 | * | 5/1955 | Drennen | 418/149 |
| 4,017,223 | * | 4/1977 | Blackwell | 418/107 |
| 5,533,887 | | 7/1996 | Maruyama et al. . | |
| 5,667,370 | | 9/1997 | Im . | |
| 6,019,586 | * | 2/2000 | Liou | 418/194 |
| 6,079,966 | * | 6/2000 | Bearin et al. | 418/98 |
| 6,129,534 | * | 10/2000 | Schofield et al. | 418/194 |
| 6,176,694 | * | 1/2001 | Fang et al. | 418/194 |

FOREIGN PATENT DOCUMENTS

| | | | | |
|---|---|---|---|---|
| 16476 | * | of 1895 | (GB) | 418/194 |
| 1140577 | * | 7/1966 | (GB) | 418/194 |
| 1-267384 | * | 10/1989 | (JP) | 418/194 |
| 6-307360 | * | 1/1994 | (JP) | 418/194 |

* cited by examiner

*Primary Examiner*—Thomas Denion
*Assistant Examiner*—Theresa Trieu
(74) *Attorney, Agent, or Firm*—Rabin & Champagne, P.C.

(57) ABSTRACT

A double screw rotor assembly includes two screw rotors meshed in a bushing inside a casing. The threads of the screw rotors have a uniform pitch, and define with the bushing a plurality of air chambers in the pitch. The volumes of the air chambers reduce gradually from the inlet toward the output due to the reduce of tooth high so that the outer diameter defined by the tooth tip of the thread of each screw rotor has the shape of an invertedly disposed cone. Adjustable spring means is provided to impart an axial spring force to the bushing relative to the casing, guide means is provided to guide axial movement of the bushing relative to the casing, and a O-ring is disposed between the top wall of the bushing and the casing. Adjusting the pre-loading of the spring means controls the dimension of the clearance between the inside wall of the bushing and the tooth tip of the thread of each screw rotor. The top wall of the busing forces the O-ring against the casing to maintain an airtight condition, so as to improve the working efficiency.

7 Claims, 8 Drawing Sheets

DOUBLE SCREW ROTOR ASSEMBLY HAVING MEANS TO AUTOMATICALLY ADJUST THE CLEARANCE BY PRESSURE DIFFERENCE

BACKGROUND OF THE INVENTION

The present invention relates to fluid machinery for controlling a fluid pressure, and more particularly to a double screw rotor assembly, which uses pressure difference to adjust the clearance automatically, so as to reduce the consumption of starting power. The double screw rotor assembly of the invention can be used in vacuum pumps, air compressors, water or oil pumps, or other fluid media.

FIG. 1 shows a double screw rotor assembly manufactured by KASHIYAMA INDUSTRIES, LTD., and designed for use in a vacuum pump. This structure of double screw rotor comprises two screw rotors 81 and 82 meshed together. Because the screw rotors 81 and 82 have a constant pitch P' and constant height of tooth H', the volume of air chamber 810 or 820 does not change while air is transferred from the inlet to the output end 80, a significant pressure difference occurs and causes a reverse flow of air, high noises, and waste of energy.

U.S. Pat. No. 5,667,370 discloses another structure of double screw rotor assembly. According to this design, as illustrated in FIG. 2, the meshed screw rotors 83 and 84 have same height of tooth H", and the pitch is made gradually reduced in direction from the input side toward the output side 801 ($P_1>P_2$). Because of $P_1>P_2$, the volume of air chamber 830 or 840 is reduced during transmission, and the pressure in these chambers would be increased gradually. Therefore, when the air cambers were compressed and transmitted to the output end 801, less pressure difference occurs, the reverse flow of air would be reduced and so as to the noise. However, because of different pitches and pressure angles are defined at different rotor section, the fabrication process of the screw rotors 83 and 84 are complicated, resulting in a high manufacturing cost.

FIG. 3 shows still another structure of double screw rotor assembly, which was filed to USPTO for a patent by the present applicant under application Ser. No. 09/372,674. According to this design, two screw rotors are meshed together and mounted in a compression chamber inside a casing, each comprising a spiral thread around the periphery. The thread has a height H made gradually reduced from the input side to the output side 90. The threads of the screw rotors define a constant pitch P in order to be manufactured easily. The volumes of the air chambers 910 and 920 reduce gradually from the input side toward the output side, so the pressure can be increased gradually during transmission of air, the consumption of operation power and noise can be reduced. Because a uniform pitch P is provided and the height H is made gradually reduced from the input side toward the output side 90, the outer diameter D has the shape of an invertedly disposed cone, and the inner diameter d has the shape of a regular cone.

According to the aforesaid second and third prior art designs, much starting power is required when starting the double screw rotor assembly. As illustrated in FIG. 3, the pressure (i.e. the atmospheric pressure) in all air chambers 910 and 920, pressure Pi at the input side, and pressure Po at the output side, at the initial stage are the same. Because the volumes of the air chambers 910 and 920 are gradually reduced during rotary motion of the screw rotors, the pressure Pmax near the output side surpasses the pressure P0 (=the atmospheric pressure) at the output side when starting the double screw rotor assembly. Therefore, much more power and electric current are required to drive the rotors 91 and 92 to conquer the flow pressure of all air chambers 910 and 920. A certain period of time after starting, the flow pressure at the input side 901 is gradually reduced (for example, being drawn into a vacuum state), causing the flow pressure in the air chambers 910 and 920 near the input side 901 to be gradually reduced, and hence the power consumed is gradually reduced to the level of the rated working power. Because high working power is required when starting the double screw rotor assembly, high current, noise and vibration occur at the initial state when starting the screw rotors, resulting in an unstable operation.

FIG. 4 shows another prior art design constructed according to U.S. Pat. No. 5,533,887. According to this design, a movable case is sliding in a fixed case, however the spring at the top of the movable case is not adjustable, and the presence of the gap 22C which is left between the movable case and the fixed case for enabling the movable case to slide in the fixed case which may cause air leakage directly from the high pressure area to the low pressure area, thereby causing a low working efficiency. Further, if the process gas condensed in the gap between movable and fixed cases, the movable case may be jammed at some position, and the bypass mechanism failed.

In view of the drawbacks of the aforesaid prior art designs, there is a strong demand for a high performance double screw rotor assembly that requires low starting power, and can be conveniently adjusted to fit different manufacturing requirement.

SUMMARY OF THE INVENTION

The present invention has been accomplished to provide a double screw rotor assembly, which eliminates the aforesaid drawbacks. It is one object of the present invention to provide a double screw rotor assembly, which reduces starting power and starting electric current automatically by adjusting the pre-loading spring to control the flow leakage, so as to prevent a motor overload, and to achieve a stable operation. It is another object of the present invention to provide a double screw rotor assembly, which achieves a high performance by preventing a leakage during its operation. According to one aspect of the present invention, the double screw rotor assembly comprises a casing having a receiving chamber; an inlet and an outlet; a bushing axially movably mounted in the receiving chamber inside the casing, the bushing having an inside wall defining a receiving chamber, and an outside wall fitting the inside wall of the casing; guide means to guide axial movement of the bushing relative to the casing; a O-ring disposed between the top wall of the bushing and the casing; two screw rotors meshed together and mounted in the receiving chamber inside the bushing; and pre-loading adjustable spring means mounted between the bushing and the casing and imparting an axial spring force to the bushing relative to the casing, wherein the adjustable spring means pushes the bushing away from the casing to increase the gap between the inside wall of the bushing and the tooth tip of each spiral thread of the screw rotors before rotation of the screw rotors, and the bushing is forced by a pressure difference between the inlet and the outlet to conquer the axial spring force from the adjustable spring means and to force the O-ring against the casing after rotation of the screw rotors, thereby causing the gap between the inside wall of the bushing and the tooth tip of each spiral thread of the screw rotors to be gradually reduced. According to another aspect of the present invention, spring, hydraulic cylinder, pneumatic cylinder, elastomer, or any other equivalent means can be used for the adjustable spring means. According to still another aspect of the present invention, the guide means comprises at least one sliding groove formed on the outside wall of the bushing, and at least one guide rib respectively formed integral with the inside wall of the casing and coupled to the at least one sliding groove on the bushing. The O-ring can be made of rubber, or any suitable equivalent sealing material. The sliding groove and the guide rib can be made having any of a variety of designs that facilitate stable movement of the bushing relative to the casing. Further, the outer diameter of the thread of each screw rotor can be made linearly or non-linearly reduced from the inlet toward the outlet, having a convex or concave profile.

DETAILED DESCRIPTION OF THE PREFERRED EMBODIMENT

Figure 1:
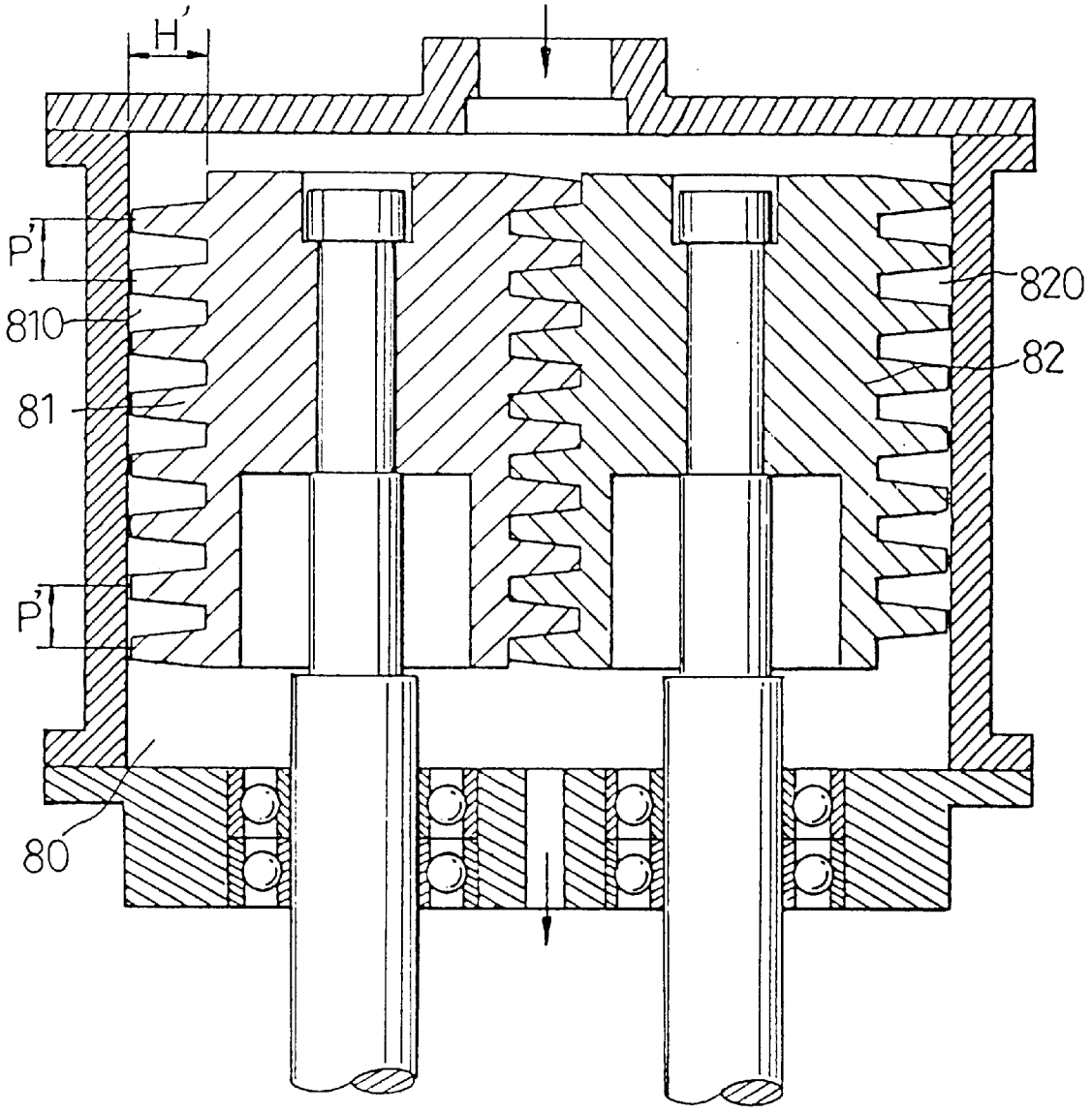
Fig. 1 PRIOR ART
FIG. 1 is a sectional view of a double screw rotor assembly according to the prior art.
Figure 2:
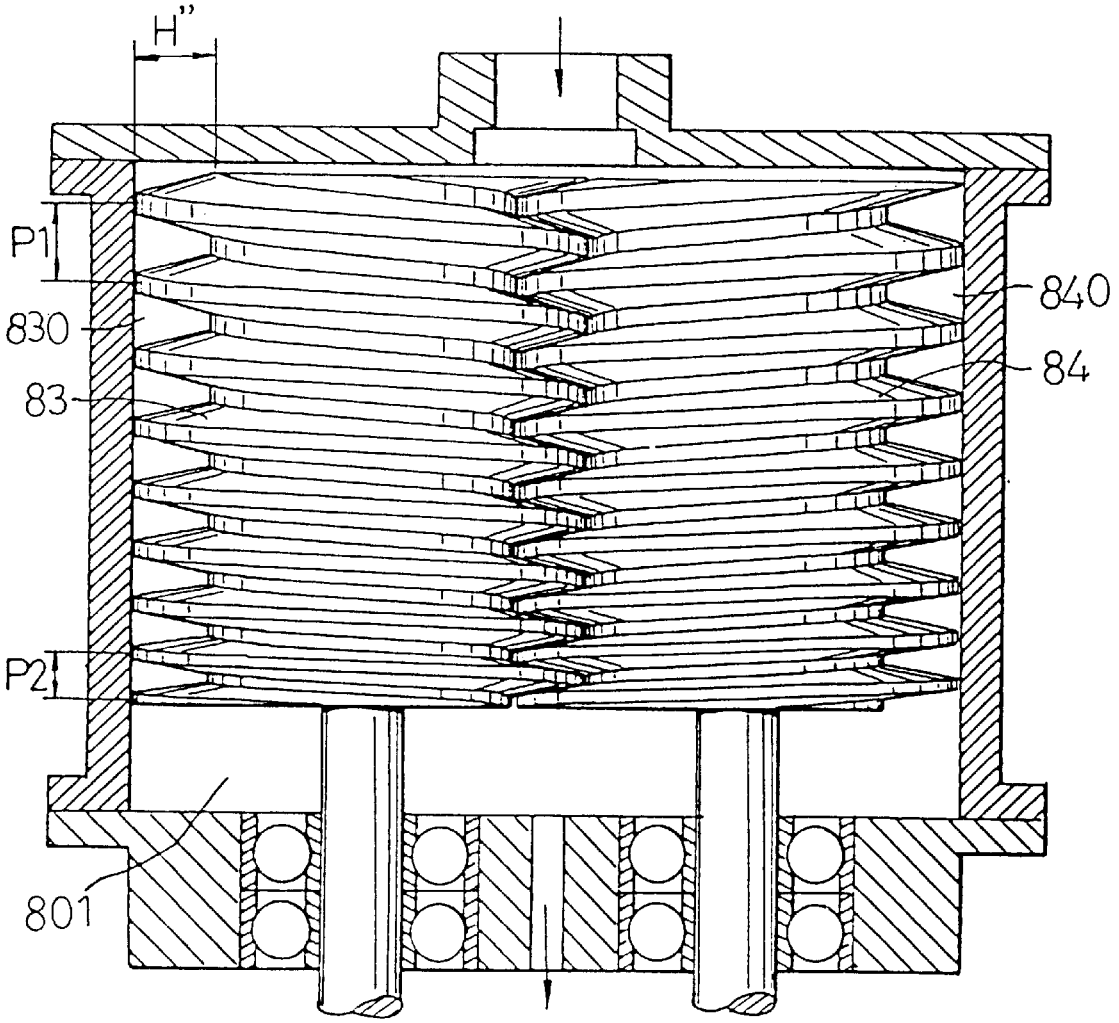
Fig. 2 PRIOR ART
FIG. 2 is a sectional view of another structure of double screw rotor assembly according to the prior art.
Figure 3:
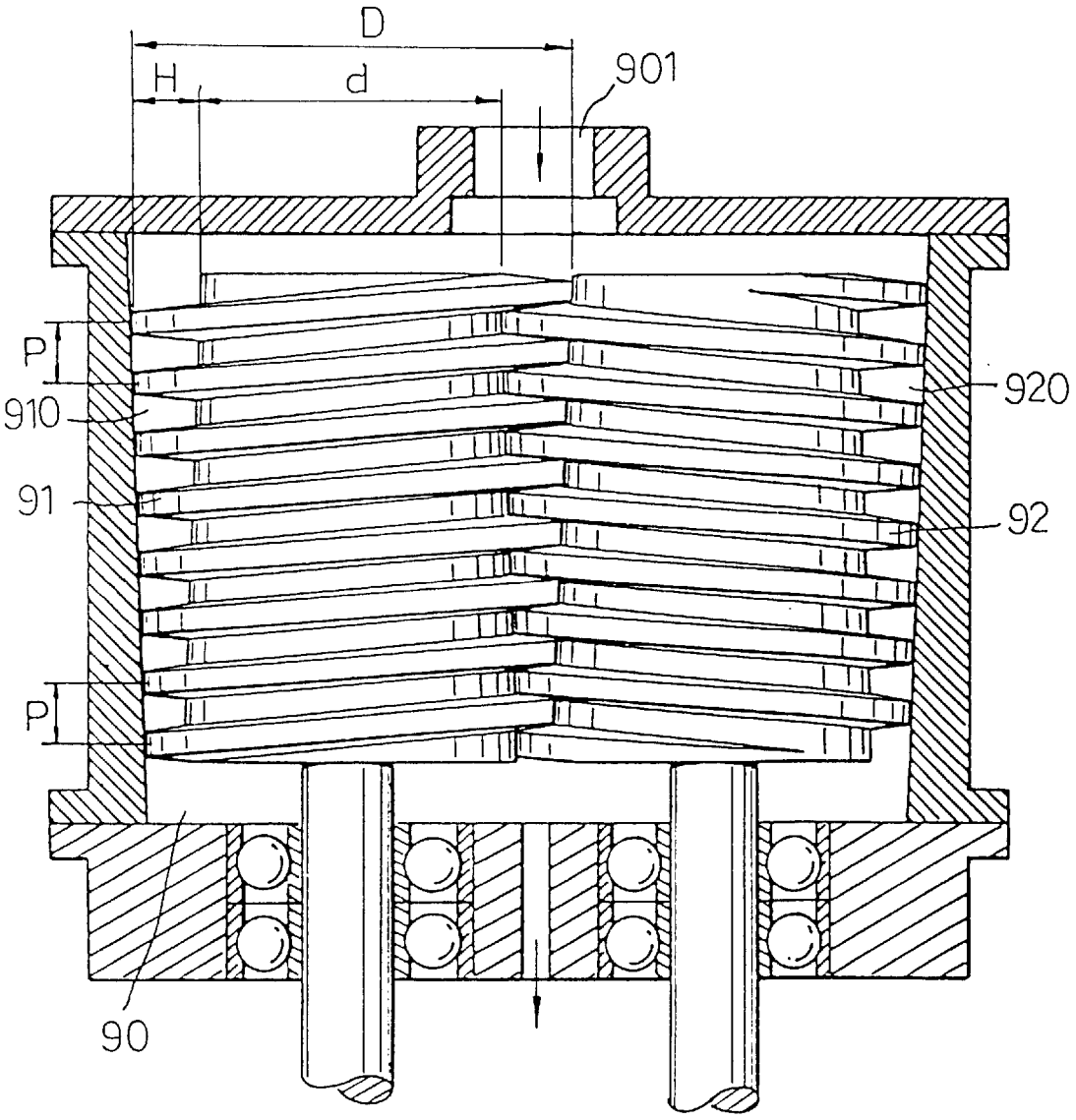
Fig. 3 PRIOR ART
FIG. 3 is a sectional view of still another structure of double screw rotor assembly according to the prior art.
Figure 4:
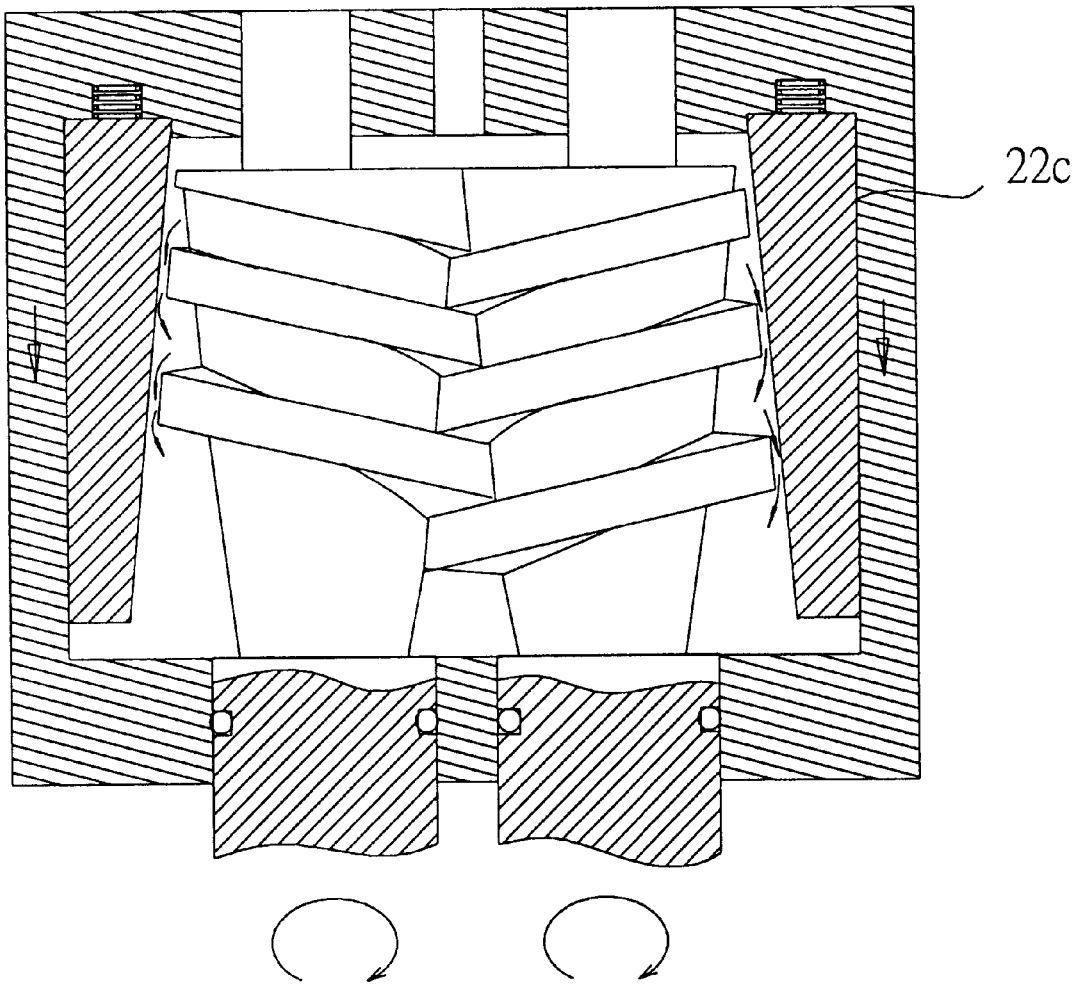
Fig. 4 PRIOR ART
FIG. 4 is a sectional view of still another structure of double screw rotor assembly according to the prior art.
Figure 5:
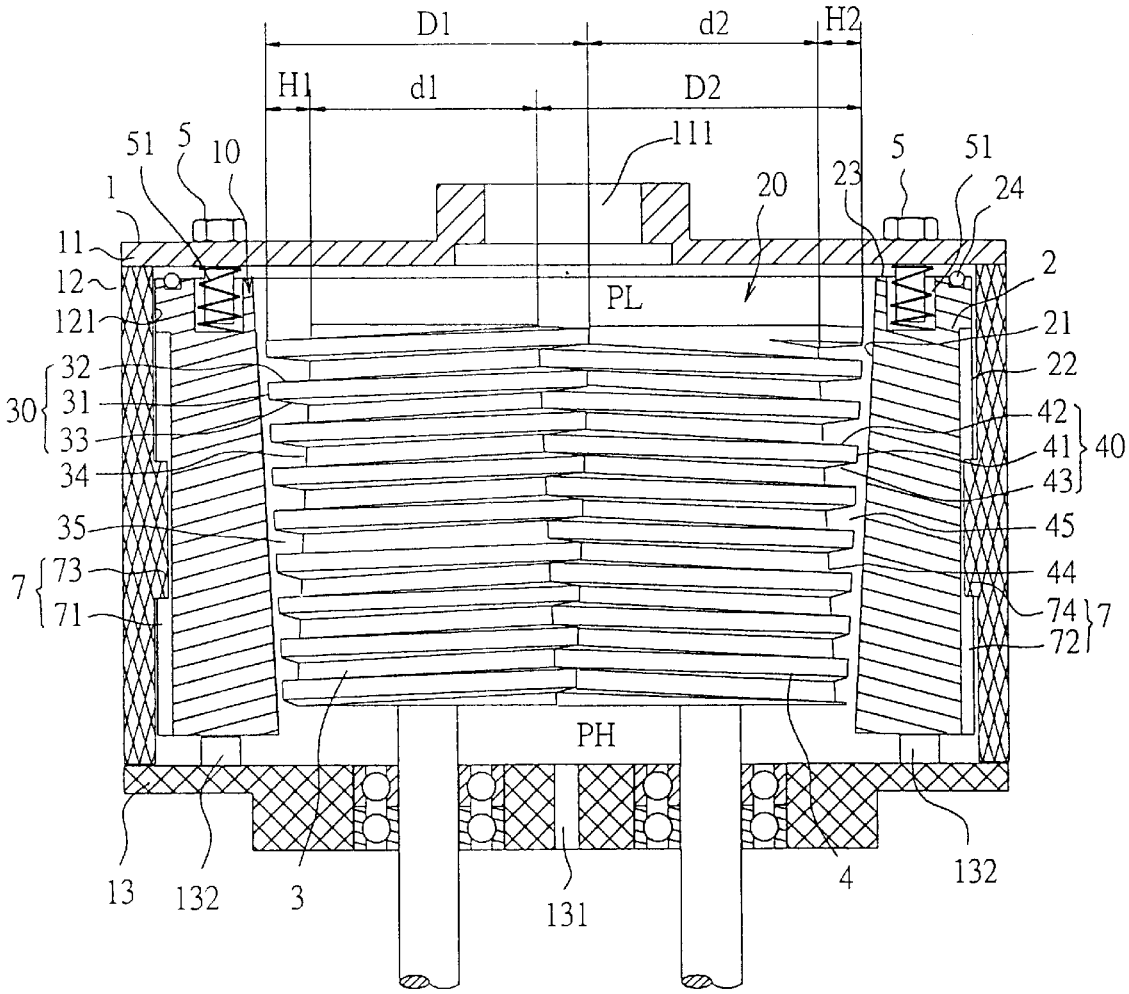
FIG. 5 is a sectional view of a double screw rotor assembly according to the present invention when initially started.
Figure 6:
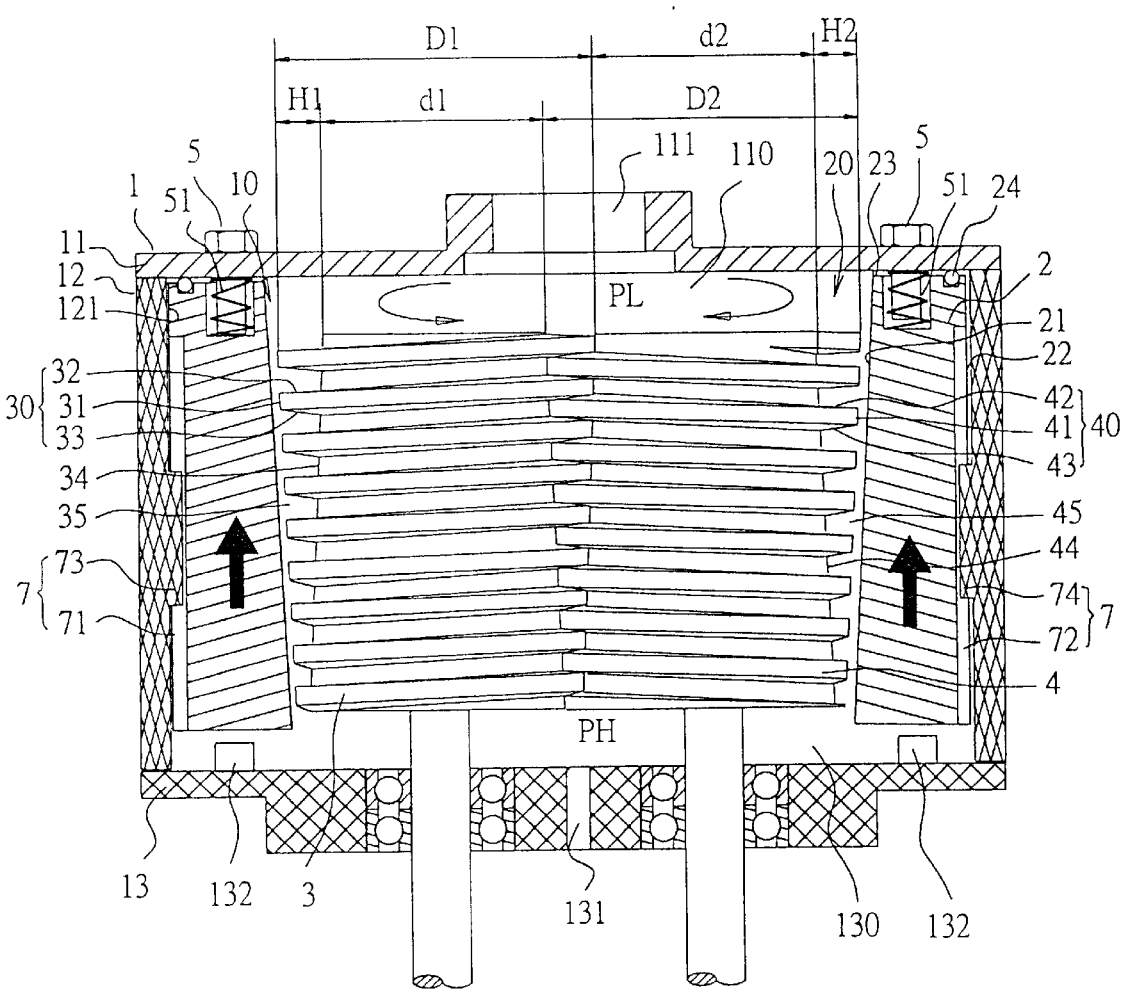
FIG. 6 is a sectional view of the present invention, showing the status of the double screw rotor assembly a certain period of time after starting.

Referring to FIGS. 5 and 6, a double screw rotor assembly used in a vacuum pump in accordance with the present invention is shown comprised of a casing 1, a bushing 2, two screw rotors 3 and 4, and adjustable pre-loading spring means 5.

The casing 1 comprises a top cover 11, a peripheral shell 12, and a bottom cover 13. The top cover 11 has an inlet 111 connected to a container to be drawn into a vacuum status. The peripheral shell 12 comprises an inside wall 121 defining a receiving chamber 10. The bottom cover 13 comprises an outlet 131 disposed in communication with the atmosphere.

The bushing 2 has a loop-like, or more specifically, double loop-like cross section mounted in the receiving chamber 10 inside the casing 1, comprising an inside wall 21, a receiving chamber 20 defined within the inside wall 21, a top wall 23, a O-ring 24 mounted on the top wall 23, and an outside wall 22 fitting the inside wall 121 of the peripheral shell 12 of the casing 1. Further, guide means 7 is provided for enabling the bushing 2 to be moved axially relative to the casing 1. The guide means 7 comprises two longitudinal sliding grooves 71 and 72 respectively formed on the outside wall 22 at two opposite sides, and two longitudinal guide ribs 73 and 74 respectively bilaterally formed integral with the inside wall 121 of the peripheral shell 12 of the casing 1 and coupled to the longitudinal sliding grooves 71 and 72.

The two screw rotors 3 and 4 are meshed together, and mounted inside the receiving chamber 20 in the bushing 2. Each screw rotor 3 or 4 comprises a spiral thread 30 or 40 raised around the periphery (Alternatively, the screw rotors 3 and 4 can be made having two or more threads). The tooth tips 31 and 41 of the threads 30 and 40 of the screw rotors 3 and 4 are respectively spirally extended, defining a respective outer diameter D1 and D2 and meshed with each other. As illustrated, the threads 30 and 40 define a uniform pitch, and the outer diameter D1 or D2 reduces gradually and linearly from the inlet 111 toward the outlet 131.

The thread 30 or 40 defines with the inside wall 21 of the bushing 2 a plurality of air chambers 35 or 45 in the respective pitch, i.e., the root of tooth 34 or 44, the side walls 32 and 33, or, 42 and 43, and the inside wall 21 of the bushing 2 define a plurality of air chambers 35 or 45. As illustrated, the outer diameters D1 and D2 that are formed of the tooth tips 31 and 41 of the threads 30 and 40 of the screw rotors 3 and 4 fit the inside wall 21 of the bushing 2, therefore the inside wall 21 of the bushing 2 is linearly tapered. Each thread 30 or 40 has two side walls 32 and 33, or, 42 and 43. The root of tooth 34 or 44 defines an inner diameter d1 or d2 having the shape of a regular cone. Because the tooth height H1 or H2 gradually reduces in direction from the inlet 111 toward the outlet 131, the volumes of the air chambers 35 or 45 were gradually reduced in direction from the inlet 111 toward the outlet 131.

Figure 7A:
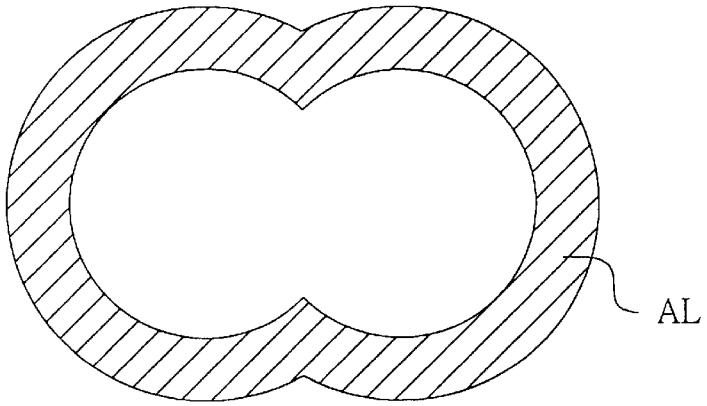
FIG. 7A is a top view of the bushing according to the present invention.

The aforesaid spring means 5 is, for example, comprised of two springs 51 bilaterally stopped between the topmost edge of the bushing 2 and the bottom side wall of the top cover 11 of the casing 1. According to the present preferred embodiment, the pre-loading of the springs 51 are adjustable, and two screw bolts are respectively provided for adjusting the pre-load of the springs 51, so as to relatively adjust axial spring power. Referring to FIG. 5, when starting the double screw rotor assembly, the flow pressure PL around the inlet 111 and the flow pressure PH around the outlet 131 are both equal to the atmospheric pressure at the beginning (PL=PH=1 atm), i.e., there is no pressure difference in the double screw rotor assembly, therefore the bushing 2 is forced axially downwards by the adjustable springs 51 and stopped at a stop ring 132 above the bottom cover 13. At this stage, as illustrated in FIG. 7, a larger clearance t exists between the tooth tip 41 of the screw rotor 4, which has the shape of an invertedly disposed cone, and the inside wall 21 of the bushing 2, therefore air is allowed to flow slightly from the air chamber 45 of relatively higher pressure toward the air chamber 45' of relatively lower pressure via the clearance t at the beginning of the rotation of the screw rotors 3 and 4, and less starting electric power is required to start the double screw rotor assembly.

Figure 7B:
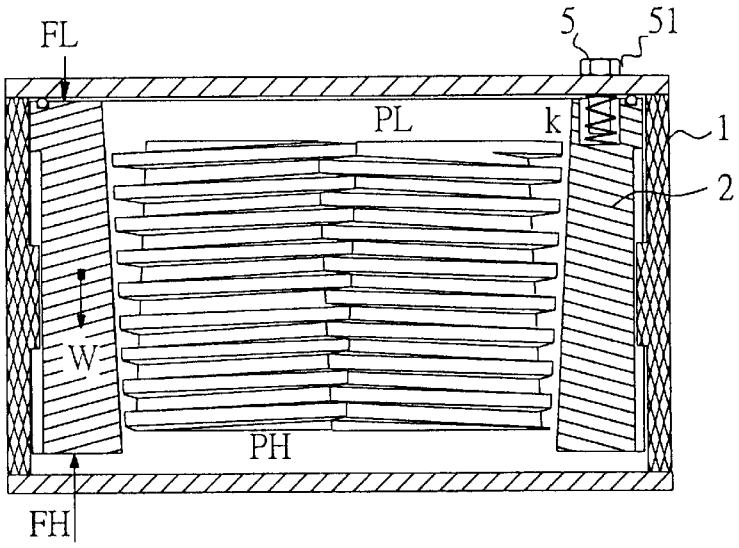
FIG. 7B is a schematic drawing explaining the balanced status of force a certain period of time after start of the double screw rotor assembly.
Figure 7C:
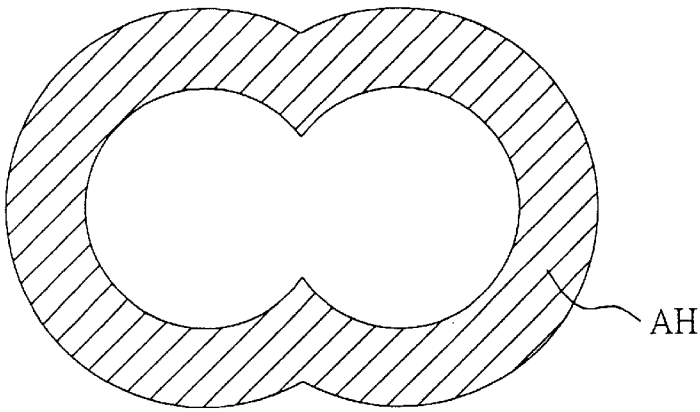
FIG. 7C is a bottom view of the bushing according to the present invention.
Figure 9:
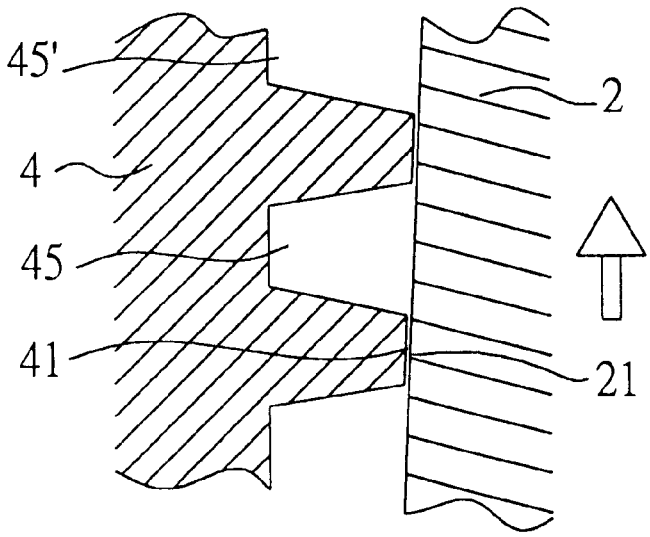
FIG. 9 is an enlarged view in section of a part of the present invention, showing the status of the double screw rotor assembly a certain period of time after start.

Referring to FIG. 6, a certain period of time after starting, the flow pressure PL around the inlet 111 is gradually reduced, forming a low pressure zone 110, and the flow pressure PH around the outlet 131 is maintained unchanged, forming a relatively high pressure zone 130 (PL<PH=1 atm). Please see also FIG. 7B. The projected area AL of the bushing 2 in the low pressure zone 110 in axial direction (see FIG. 7A) is smaller than the projected area AH of the bushing 2 in the high pressure zone 130 (see FIG. 7C) (AL<AH). Therefore, the force upon the low pressure side of the bushing 2 is FL=PL*AL, the force upon the high pressure side of the bushing 2 is FH=PH*AH, and FL<FH when PL<PH and AL<AH. The force balanced equation, as shown in FIG. 7B, is: FH−FL=W+k*ϵ, wherein W is the weight of the bushing 2; k is the coefficient of elasticity of the adjustable spring 51; ϵ is displacement of the adjustable spring 51, k*ϵ is the pre-loading of the adjustable spring, FH−FL has a great concern with the grade of the vacuum pump. Because FH−FL, W, ϵ are all known when designed, adjusting the pre-loading of the adjustable springs 51 to control the dimension of the clearance t. The invention is feasible, and has industrial value. Physically, when the pressures at the two opposite ends of the bushing 2 are unequal, the bushing 2 is forced axially upwards to conquer the axial spring force of the adjustable springs 51, and the adjustable springs 51 will be compressed to a relatively shorter condition if the pressure difference between the two opposite ends of the bushing 2 is relatively increased. FIG. 9 shows the aforesaid working status where the busing 2 is pushed axially upwards into close contact with the tooth tip 41 of the screw rotor 4, and at the same time, the O-ring 24 at the top wall 23 of the busing 2 is compressed and maintained in the sealing status (see FIG. 6), preventing gas leak from high pressure side to 130 the receiving chamber 20 via the clearance between outside wall 22 and top wall 23 of the bushing 2, and therefore the working efficiency is greatly improved.

Figure 8:
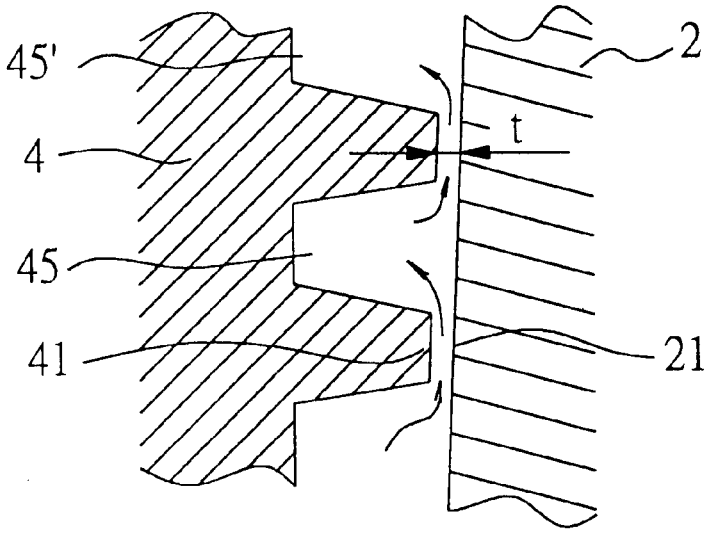
FIG. 8 is an enlarged view in section of a part of the present invention showing the initial stage of the double screw rotor assembly when started.

When turning off the screw rotors 3 and 4, the pressure around the high pressure zone 130 and the pressure around the low pressure zone 110 are returned to the balanced status, the bushing 2 is moved down by the adjustable springs 51 to its former position and stopped at the locating ring 132, and the clearance t is opened again (see FIGS. 5 and 8), waiting for a next run.

While only one embodiment of the present invention has been shown and described, it will be understood that various modifications and changes could be made thereunto without departing from the spirit and scope of the invention disclosed.

What the invention claimed is:

1. A double screw rotor assembly comprising:

a casing, said casing comprising an inside wall defining a receiving chamber, an inlet and an outlet respectively disposed in communication with the receiving chamber of said casing;

a bushing mounted in the receiving chamber inside said casing and moved axially along the inside wall of said casing, said bushing having a double loop-like cross section and comprising an inside wall defining a receiving chamber and an outside wall fitting the inside wall of said casing;

guide means to guide axial movement of said bushing relative to said casing;

an O-ring mounted on said bushing at a top side and facing said casing;

two screw rotors meshed together and mounted in the receiving chamber inside said bushing, said screw rotors each comprising at least one spiral thread of a constant pitch, said at least one spiral thread each comprising a tooth tip, two side walls, and a root of tooth, said tooth tip of said at least one spiral thread of each of said screw rotors defines an outer diameter having the shape of an invertedly disposed cone; and pre-loading adjustable spring means mounted between said bushing and said casing and imparting an axial spring force to said bushing relative to said casing, wherein said adjustable spring means pushes said bushing away from said casing to increase the gap between the inside wall of said bushing and the tooth tip of each spiral thread of said screw rotors before rotation of said screw rotors, and said bushing is forced by a pressure difference between said inlet and said outlet to conquer the axial spring force from said adjustable spring means and to force said O-ring against said casing after rotation of said screw rotors, thereby causing the gap between the inside wall of said bushing and the tooth tip of each spiral thread of said screw rotors to be gradually reduced.

2. The double screw rotor assembly of claim 1 wherein said guide means comprises at least one sliding groove formed on the outside wall of said bushing, and at least one guide rib respectively formed integral with the inside wall of said casing and coupled to the at least one sliding groove on said bushing.

3. The double screw rotor assembly of claim 1 wherein said casing is comprised of a peripheral shell, a top cover, and a bottom cover.

4. The double screw rotor assembly of claim 1 wherein said outer diameter gradually linearly reduces from said inlet toward said outlet.

5. The double screw rotor assembly of claim 1 wherein said at least one spiral thread of each of said screw rotors each has a root of tooth and side walls that define with the inside wall of said bushing at least one air chamber, and the air chambers defined between said screw rotors and the inside wall of said bushing have a volume gradually reduced from said inlet toward said outlet.

6. The double screw rotor assembly of claim 1 wherein said adjustable spring means is an adjustable spring.

7. The double screw rotor assembly of claim 1 wherein said O-ring is made of rubber.

* * * * *